United States Patent [19]

Popkin

[11] Patent Number: 4,860,649

[45] Date of Patent: Aug. 29, 1989

[54] OFFSET PRESS WITH ADJUSTABLE AXLE-BEARING ASSEMBLY FOR IMPRESSION CYLINDER

[76] Inventor: Leonard I. Popkin, 84-28 115th St., Richmond Hill, N.Y. 11418

[21] Appl. No.: 249,120

[22] Filed: Sep. 26, 1988

[51] Int. Cl.[4] ..... B41F 9/00

[52] U.S. Cl. ..... 101/137; 101/247

[58] Field of Search ..... 101/216, 247, 218, 137, 101/139, 140, 142, 143, 144, 145, 181, 182, 184, 185

[56] References Cited

U.S. PATENT DOCUMENTS

| | | | |
|---|---|---|---|
| 3,732,814 | 5/1973 | Pasquinelli | 101/247 |
| 3,817,174 | 6/1974 | Paulson | 101/247 |
| 4,122,772 | 10/1978 | Dahlgren | 101/218 |
| 4,290,361 | 9/1981 | Fowler et al. | 101/247 |
| 4,591,536 | 5/1986 | Hodes et al. | 428/643 |
| 4,643,090 | 2/1987 | McKrell et al. | 101/247 |

*Primary Examiner*—Eugene M. Eickholt
*Attorney, Agent, or Firm*—Michael Ebert

[57] ABSTRACT

A rotary offset press in which an inked image carried by a plate cylinder is transferred to a blanket cylinder from which the image is offset to a paper sheet fed into the nip between the blanket cylinder and an impression cylinder. The opposite ends of the impression cylinder axle are received in bearings which fit into the bores of a pair of like cylindrical bushings supported on the frame of the press. Each bore is eccentric with respect to the outer circumference of the bushing. The bushings are coupled to a pair of ganged crank mechanisms which function to concurrently adjust the rotary angle of the bushings and thereby the size of the nip between the impression cylinder and the blanket cylinder to provide a printing pressure appropriate to the paper to be fed into the nip.

5 Claims, 1 Drawing Sheet

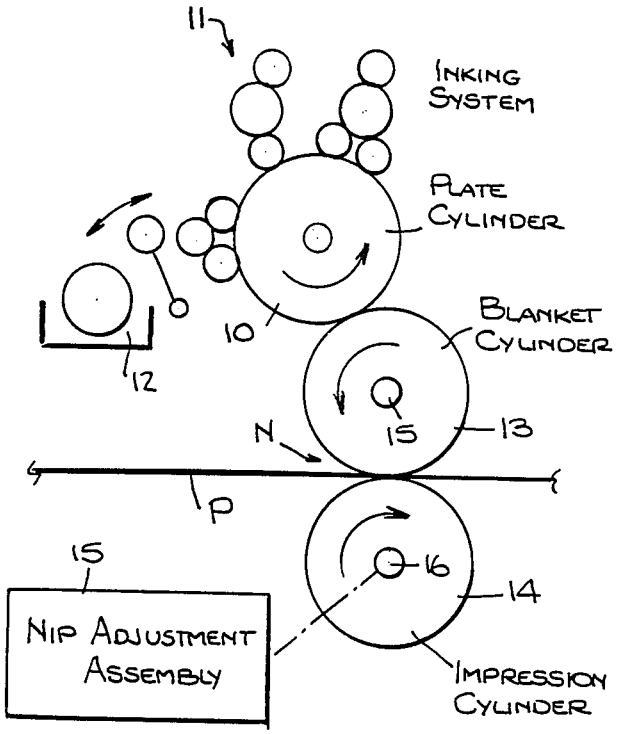
Fig. 1.
Fig. 3.
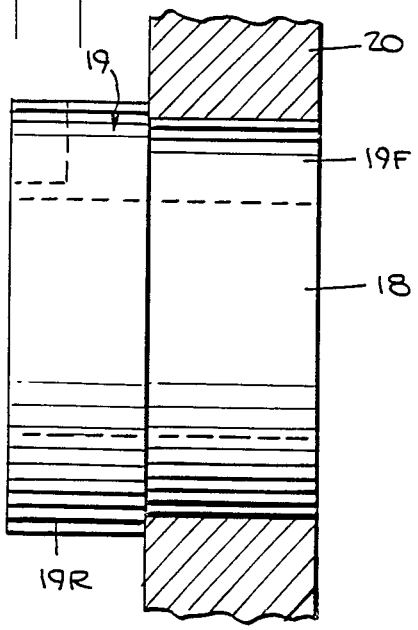
Fig. 2.
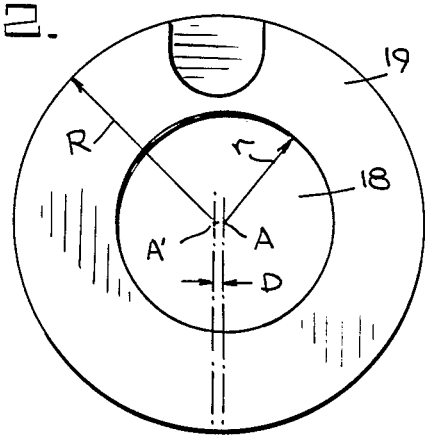
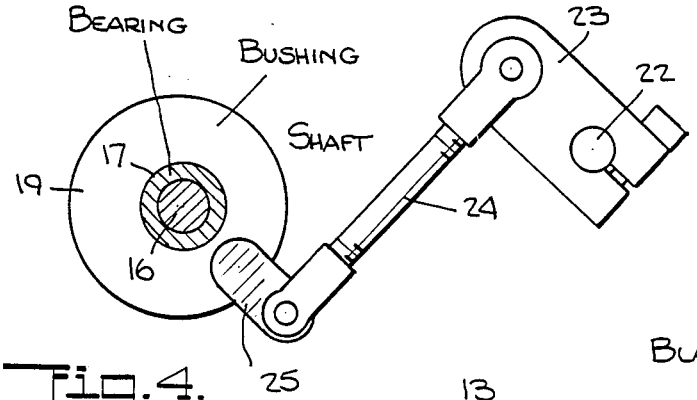
Fig. 4.
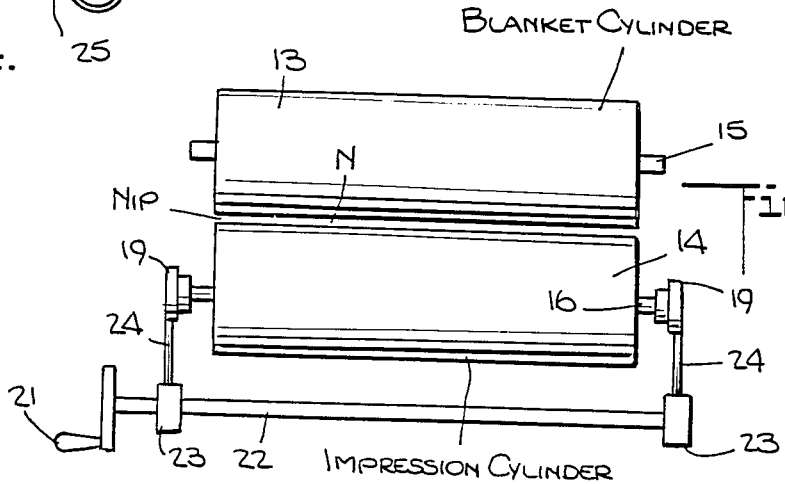
Fig. 5.

OFFSET PRESS WITH ADJUSTABLE AXLE-BEARING ASSEMBLY FOR IMPRESSION CYLINDER

BACKGROUND OF INVENTION

1. Field of Invention:

This invention relates generally to offset presses in which paper to be printed is fed into a nip between a blanket cylinder and an impression cylinder, and more particularly to an adjustable axle-bearing assembly for the impression cylinder which makes it possible to set the nip to establish a printing pressure appropriate to the paper being printed.

2. Status of Prior Art:

The planographic printing process is based on an 18th Century invention of Alois Seefelder, which makes use of a smooth stone and exploits the antipathy of grease and water, the printing ink adhering only to greasy image areas on the stone face. Planographic printing is also called lithography, "litho" being the Greek term for stone. Except as an art medium, some lithography has ceased to exist.

Modern offset printing is an extension of lithography and uses a thin metal relief image plate, the inked image being transferred from a plate cylinder to a rubber-covered cylinder called the blanket cylinder. From the blanket cylinder the image is "offset" onto a paper sheet carried by an impression cylinder, the paper being fed into a nip between the blanket and impression cylinders. Rotary offset presses make possible increased production speeds, improved quality in the reproduction of fine tones, and a substantial reduction in the number of impressions required to reproduce full color copy.

The principal raw material for paper making is wood pulp, but better papers are made with cotton linters or rags. Papers are often calendered, coated or laminated and vary not only in grade or thickness, but have different finishes. Hence, a printing pressure appropriate to one type of paper may result in poor quality printing in another type of paper of the same thickness.

The printing pressure applied to the paper fed into the nip between the rubber-covered blanket cylinder and the impression cylinder depends on the size of the nip therebetween. In the typical offset press, the nip size can be adjusted to a limited degree. Since the quality of printing depends on the printing pressure, with some papers even the maximum degree of nip adjustment available on the typical press on the pressure is insufficient to afford the desired quality of printing.

The need exists, therefore, for means to adjust the size of the nip between the impression cylinder and the blanket cylinder to provide a range of printing pressures appropriate to the full range of papers that may be fed into this nip.

SUMMARY OF INVENTION

In view of the foregoing, the main object of this invention is to provide an adjustable axle-bearing assembly for the impression cylinder of an offset press which makes it possible to set the nip between this cylinder and the blanket cylinder to establish a printing pressure appropriate to the paper being printed.

A significant advantage of an adjustable axle-bearing assembly in accordance with the invention is that it lends itself to retrofitting on an existing offset press without otherwise modifying the press.

Also an object of the invention is to provide a low cost assembly of the above type which is relatively easy to adjust and which operates efficiently and reliably.

Briefly stated, these objects are attained in a rotary offset press in which an inked image carried by a plate cylinder is transferred to a blanket cylinder from which the image is offset to a paper sheet fed into the nip between the blanket cylinder and an impression cylinder. The opposite ends of the impression cylinder axle are received in bearings which fit into the bores of a pair of like cylindrical bushings supported on the frame of the press. Each bore is eccentric with respect to the outer circumference of the bushing. The bushings are coupled to a pair of ganged crank mechanisms which function to concurrently adjust the rotary angle of the bushings and thereby the size of the nip between the impression cylinder and the blanket cylinder to provide a printing pressure appropriate to the paper to be fed into the nip.

BRIEF DESCRIPTION OF DRAWINGS

For a better understanding of the invention as well as other objects and further features thereof, reference is made to the following detailed description to be read in conjunction with the accompanying drawings, wherein:

FIG. 1 schematically illustrates the main components of an offset press that includes an adjustable axle bearing assembly for the impression cylinder in accordance with the invention;

FIG. 2 illustrates the eccentric relation between the bore and the bushing included in the assembly and its outer circumference;

FIG. 3 is a side view of the bushing supported in the frame of the press;

FIG. 4 shows the crank for adjusting the rotary angle of the bushing; and

FIG. 5 is an elevational view illustrating the relationship of the plate cylinder of the offset press and the impression cylinder whose axle is supported by the adjustable assembly to set the nip between these cylinders.

DESCRIPTION OF INVENTION

Referring now to FIG. 1, there is shown the basic elements of an offset printing press to which is applicable an adjustable axle-bearing assembly in accordance with the invention. The press includes a plate cylinder 10 which is inked by means of an inking system 11 having rollers that act to transfer printing ink from a supply trough 12 to the surface of the plate cylinder.

The inked image on plate cylinder 10 is transferred to a rubber-covered blanket cylinder 13. From blanket cylinder 13, the image is "offset" onto a paper sheet P fed into a nip N between the blanket cylinder 13 and impression cylinder 14. Blanket cylinder 13 is supported for rotation on an axle 15 whose ends are journalled in bearings supported on the frame of the press. Impression cylinder 14 is supported for rotation on an axle 16 whose ends are journalled in bearings supported on the frame of the press.

However, in an assembly in accordance with the invention each bearing for axle 16 of the impression cylinder is received in the bore of a cylindrical bushing which is eccentric with respect to the outer circumference of the bushing. A nip adjustment assembly 15 associated with axle 16 of the impression cylinder is adapted to adjust the rotary angle of the bushing for this axle and thereby the size of nip N between the impression and blanket cylinders.

As shown in FIGS. 2, 3 and 4, each end of the shaft or axle 16 of the impression cylinder is received in a cylindrical bearing 17 and is concentric therewith, the bearing being made of sintered carbon steel or other material having a low coefficient of friction. Bearing 17 is socketed within the bore 18 of a cylindrical bushing 19*k* preferably formed of stainless steel. As shown separately in FIG. 3, bushing 19 is provided with a front section 19F that is snugly received within an opening in frame 20 of the press, the diameter of front section 19F being reduced relative to that of the rear section 19R to create a shoulder at the junction of these sections which rests against the outer wall of the frame.

As shown in FIG. 2, bushing 19 has a longitudinal axis A and a radius 4. Bore 18 in the bushing is eccentric with respect to the outer circumference of the bushing and has a radius 4 and a longitudinal axis A'. The degree of eccentricity depends on the displacement D between axis A of the bushing and axis A' of the bore 18 therein.

The longitudinal axis A of the bushing 19 in whose bore 18 is socketed bearing 17 for axle 16 of impression cylinder 14 is in vertical alignment with the axis of rotation of axle 15 of blanket cylinder 13. But because bore 18 is eccentric, as one changes the rotary angle of bushing 19, the gap or nip N between the impression and blanket cylinders is caused to increase or decrease to a degree that depends on whether the bushing is turned clockwise or counterclockwise and the extent of angular change.

In order to effect a desired adjustment in nip size by varying the rotary angle of the bushings 19 supporting the bearings 17 at the ends of the impression cylinder axle 16, a hand-operated crank mechanism is provided. As shown in FIGS. 4 and 5, this mechanism includes a handle 21 attached to one end of a shaft 22 that is parallel to impression cylinder 14 on the side thereof opposite to the side forming nip N so as not to interfere with paper feed. Mounted on shaft 22 adjacent either end of the impression cylinder are a pair of crank arms 23, each of which is pivotally coupled to one end of a turnbuckle link 24. The other end of this link is pivotally coupled to a lug 25 projecting from bushing 19, so that rotation of shaft 22 brings about a rotation of bushing 19.

Since the crank mechanisms operated by the crank handles 21 for the respective bushings are ganged together, they serve to effect concurrent adjustments to produce a nip size whose size is uniform throughout its length. Thus, whenever one wishes to get the nip to a value appropriate to the paper to be printed, one operates the crank handle to produce the desired nip.

Inasmuch as existing offset presses are provided with impression cylinders whose bearings are supported in bushings, it is a relatively simple matter to retrofit these presses with an adjustable axle-bearing assembly in accordance with the invention.

While there has been shown and described a preferred embodiment of an offset press with adjustable axle-bearing assembly for impression cylinder in accordance with the invention, it will be appreciated that many changes and modifications may be made therein without, however, departing from the essential spirit thereof.

I claim:

1. A rotary offset press in which an inked image carried by a plate cylinder is transferred to a blanket cylinder from which the image is offset to a paper sheet fed into a nip between the blanket cylinder and an impression cylinder which is mounted for rotation on an axle, each end of which is received in a cylindrical bearing; an adjustable axle-bearing assembly for the impression cylinder for setting the nip to a value appropriate to a paper sheet being fed into the nip, said assembly comprising:

A. a cylindrical bushing having a circular bore therein to accommodate one of said cylindrical bearings, said bore being eccentric with respect to the outer circumference of the bushing; and B. a crank mechanism coupled to the bushing at each end of the impression cylinder to adjust the rotary angle thereof and thereby the size of the nip to provide a printing pressure appropriate to the paper sheet being printed, said crank mechanism including a crank arm pivotally coupled to one end of a link whose other end is pivotally coupled to a lug projecting from the bushing; a common shaft supported for rotation at a position parallel to the impression cylinder, the crank arm for each bushing being mounted on said shaft, and a handle attached to one end of the shaft to effect concurrent adjustment of the bushings whereby the resultant nip size is uniform throughout its length.

2. An assembly as set forth in claim 1, wherein said bearings are formed of sintered metal having a low coefficient of friction.

3. An assembly as set forth in claim 2, wherein said bushing is formed of stainless steel.

4. An assembly as set forth in claim 1, wherein said printing press is provided with a frame having an opening therein to receive the bushing, said bushing having a front section of reduced diameter which is received in the opening, said front section defining a shoulder with a larger diameter rear section or the bushing which lies against the inner surface of the frame.

5. An assembly as set forth in claim 1, wherein said link is a turnbuckle.

* * * * *